US006435762B1

(12) United States Patent
Markling

(10) Patent No.: US 6,435,762 B1
(45) Date of Patent: Aug. 20, 2002

(54) BLOW MOLDED BARRICADE

(76) Inventor: Floyd F. Markling, 1200 Columbian, Punta Gorda, FL (US) 33950

( * ) Notice: Subject to any disclaimer, the term of this patent is extended or adjusted under 35 U.S.C. 154(b) by 0 days.

(21) Appl. No.: 09/723,880

(22) Filed: Nov. 28, 2000

(51) Int. Cl.[7] ..... E01F 13/00
(52) U.S. Cl. ..... 404/6; 49/49
(58) Field of Search ..... 404/6, 9, 10, 15, 404/16; 256/13.1; 116/63 P; 49/37, 49, 131, 463; 160/128, 351, 377; 248/472

(56) References Cited

U.S. PATENT DOCUMENTS

| | | | | | |
|---|---|---|---|---|---|
| 381,437 | A | * | 4/1888 | Smith | 248/456 |
| 1,776,447 | A | * | 9/1930 | Parkhurst | 404/10 |
| 2,164,985 | A | * | 7/1939 | Cardarelli | 40/610 |
| 2,235,280 | A | * | 3/1941 | Carver | 248/472 |
| 2,235,282 | A | * | 3/1941 | Carver | 248/472 |
| 2,520,236 | A | * | 8/1950 | Carver | 359/553 |
| 2,525,728 | A | * | 10/1950 | Sauer | 248/472 |
| 2,623,435 | A | * | 12/1952 | Geis | 108/3 |
| 2,869,504 | A | * | 1/1959 | Andrews et al. | 116/63 P |
| 2,881,662 | A | * | 4/1959 | Harris | 248/472 |
| 3,134,184 | A | * | 5/1964 | Neblett | 49/131 |
| 3,759,214 | A | * | 9/1973 | Evans et al. | 116/63 P |
| 3,766,881 | A | * | 10/1973 | Ward | 116/63 P |
| 3,805,448 | A | * | 4/1974 | Carr et al. | 49/49 |
| 4,828,424 | A | * | 5/1989 | Crisp, Sr. | 404/6 |
| 5,117,765 | A | * | 6/1992 | Wahl | 116/63 P |
| 5,627,513 | A | * | 5/1997 | Weed et al. | 340/473 |
| 5,639,178 | A | * | 6/1997 | Wilson et al. | 404/6 |
| 5,704,730 | A | * | 1/1998 | Burton-Chambers | 404/6 |
| 5,775,253 | A | * | 7/1998 | Quan et al. | 166/63 T |

* cited by examiner

*Primary Examiner*—Gary S. Hartmann
(74) *Attorney, Agent, or Firm*—DL Tschida

(57) ABSTRACT

A blow-molded plastic, traffic control barricade. The assembly provides a hollow, blow-molded, louvered upright panel outfitted with warning indicia, lights and/or air passages that pivots from a molded hollow base. Braces mount between the base and upright panel. The panel and braces fold into a recessed cavity in the base and present a collapsed shape that occupies relatively little space and lends itself to stacking and erection and dismantling.

10 Claims, 4 Drawing Sheets

BLOW MOLDED BARRICADE

BACKGROUND OF THE INVENTION

The present invention relates to motor vehicle traffic control assemblies and, in particular, to a portable, blow molded barricade that collapses or folds to a substantially planar assembly.

Varieties of permanent and temporary barricades and lane markers are used for controlling the flow of motor vehicle traffic. The barricades and markers are erected on a road surface to direct and control traffic flow relative to the available traffic lanes. The height of the barricades and markers, numbers and spacing between assemblies makes the assemblies visible. The barricades and markers also typically include high visibility warning indicia, whereby the barricades and markers are visible during high or low light conditions.

Many barricade and marker assemblies are constructed of several sections that disassemble into a number of piece parts. Some barricades are constructed in the form of folding sawhorses. That is, a horizontal member is supported by sets of expanding or removable legs. A variety of metal-formed assemblies are also commercially available.

Several barricades are constructed of lightweight materials such as plastic or rubber. The pieces may separately stack or occupy a relatively small space during storage or transport. For example, numerous conical and barrel-shaped barricades provide separate bottom, sidewall and top sections that disassemble and independently stack. If they don't disassemble, the shapes typically permit vertical stacking. Sand or sand filled bags are frequently used to provide ballast and stabilize the barricades and markers during extended periods of use.

Some barricades provide bases that support mating vertical and horizontal pieces that assemble at a work site. Appropriate joints and braces stabilize the assemblies. Although the pieces are separately replaceable, the pieces can fail and/or become lost, thereby rendering a relatively expensive assembly effectively worthless. The erection and disassembly time can also be long, when the labor costs are considered, thereby adding to the effective cost of such collapsible assemblies.

The present invention was developed to provide a simple, self-contained, blow molded plastic barricade that collapses into a compact assembly. The assembly is low cost, occupies relatively little space, lends itself to stacking and requires little time and effort to erect or dismantle. The assembly provides a hollow, blow-molded upright panel outfitted with warning indicia that pivots from a molded base. Braces mount between the base and upright panel. The panel and braces fold into a recessed cavity in the base.

SUMMARY OF THE INVENTION

It is accordingly a primary object of the invention to provide a collapsible blow-molded, plastic barricade.

It is a further object of the invention to provide a barricade having a minimal number of self-contained parts that expand during use and collapse to self-store.

It is a further object of the invention to provide a barricade with an upright panel having a number of hollow cavities that is hinged to a base panel and self-storing hinged braces that stabilize the assembly.

It is a further object of the invention to provide a barricade wherein the upright panel collapses and stores in a recessed cavity of the base along with any braces.

It is a further object of the invention to provide a barricade wherein the upright panel includes louvers, vents, weep holes, reflective or fluorescent striping and lettering, lights and/or other high-visibility warning indicia.

The foregoing objects, advantages and distinctions of the invention, among others, are obtained in a presently preferred blow-molded barricade. The barricade is blow-molded in conventional fashion and includes an upright panel having a number of hollow cavities that hinge mounts to a base. Braces mount to interconnect and stabilize the panel and base. Stepped louver and flange surfaces separated by air passages or vents and/or containing a variety of warning indicia are provided at the upright panel. The base includes a flanged rail and/or fittings to receive the braces. The braces can be hinged to either of the pieces. Drain holes in the base relieve any collected moisture.

Still other objects, advantages, distinctions and constructions of the invention will become more apparent from the following description with respect to the appended drawings. Similar components and assemblies are referred to in the various drawings with similar alphanumeric reference characters. Various features of the invention may be configured with other features in different combinations.

DESCRIPTION OF THE PREFERRED EMBODIMENT

Figure 1:
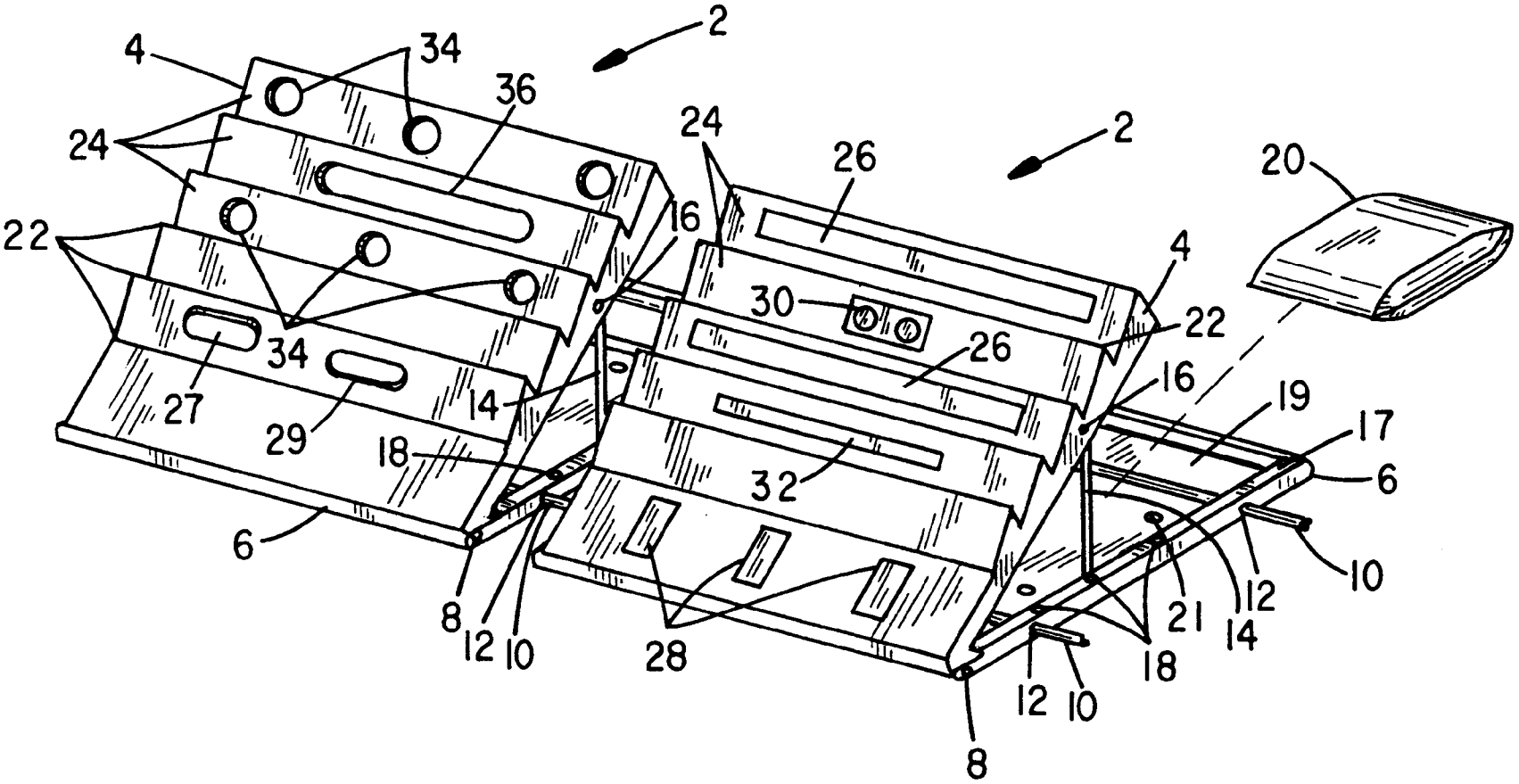
FIG. 1 is a perspective drawing showing a pair of erected barricades mounted side-by-side.
Figure 2:
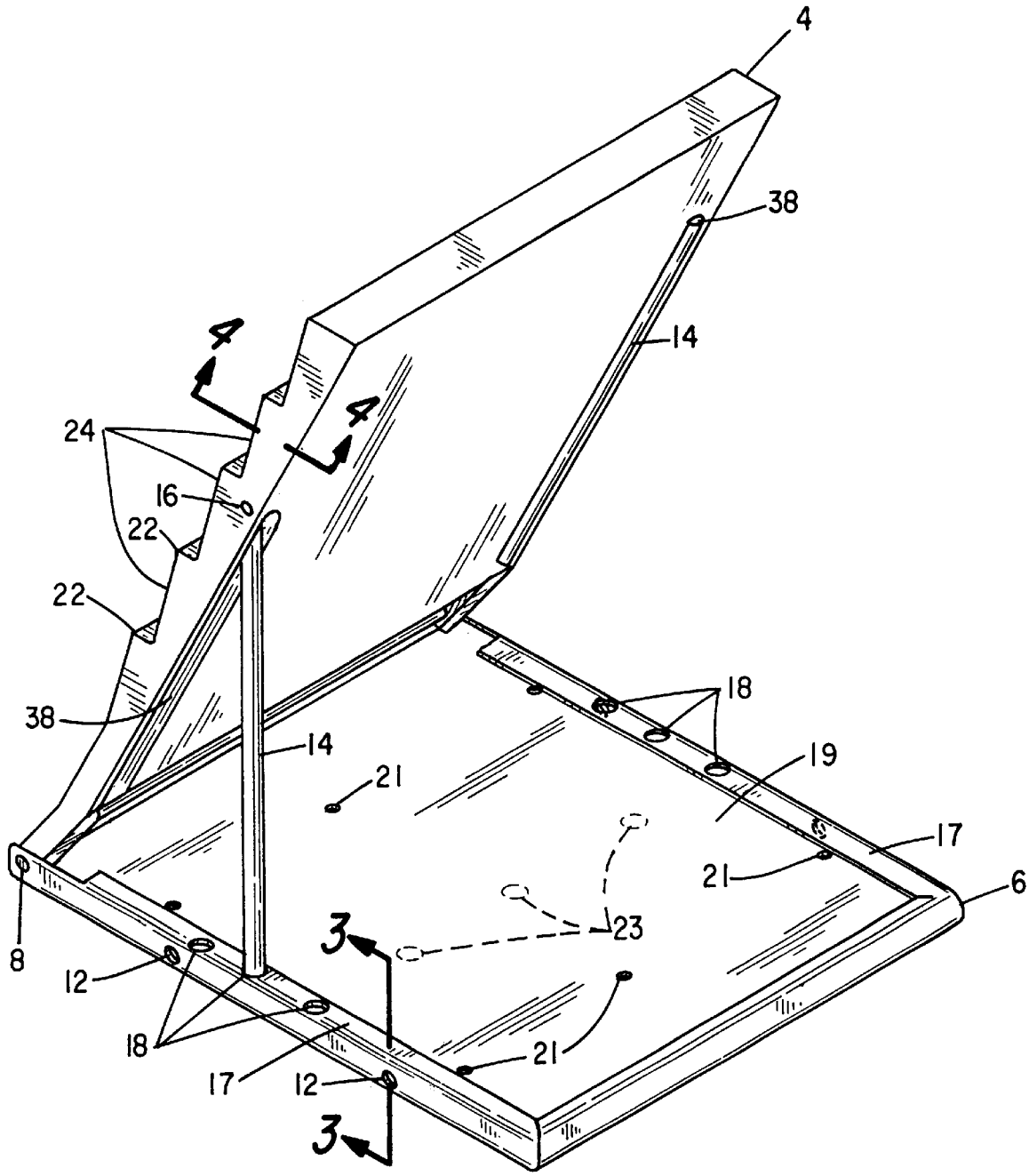
FIG. 2 is a perspective drawing showing the rear of an assembled barricade.

Referring to FIGS. 1 and 2, perspective drawings are shown to a pair of interconnected collapsible barricades 2 mounted in side-by-side relation and to a rear surface of a single one of the barricades 2. Each barricade 2 includes an upright or marker panel 4 and a bottom or base panel 6. Each marker panel 4 couples to its base panel 6 at a hinge pin or axle 8 at right and left bottom comers of the panel 4. Connecting rods 10 extend between the bases 6 and through apertures 12 at flanged rails 17 in the sides of the base panels 6. The rods 10 retain the barricades 2 as an assembly. The rods 10 can comprise lengths of re-bar or other low-cost, relatively strong members. Weighted ballast 20 can be supported on the base panels 6 to stabilize the erected barricades 2.

The marker and base panels 4 and 6 are blow molded in conventional fashion and each contains a substantially hollow core. Either of the base panels 4 and/or 6, however, can be molded such that the material at the front and rear walls are compressed to form essentially a single layer, such as the base panel 6 in FIG. 5.

Each barricade 2 is presently sized to an approximate width of 4 feet and a depth of five feet. When mounted together as shown, the two barricades 2 span approximately eight feet or a substantial portion of the width of a traffic lane. Additional barricades can be coupled together as necessary to accommodate a desired width.

Figure 3:
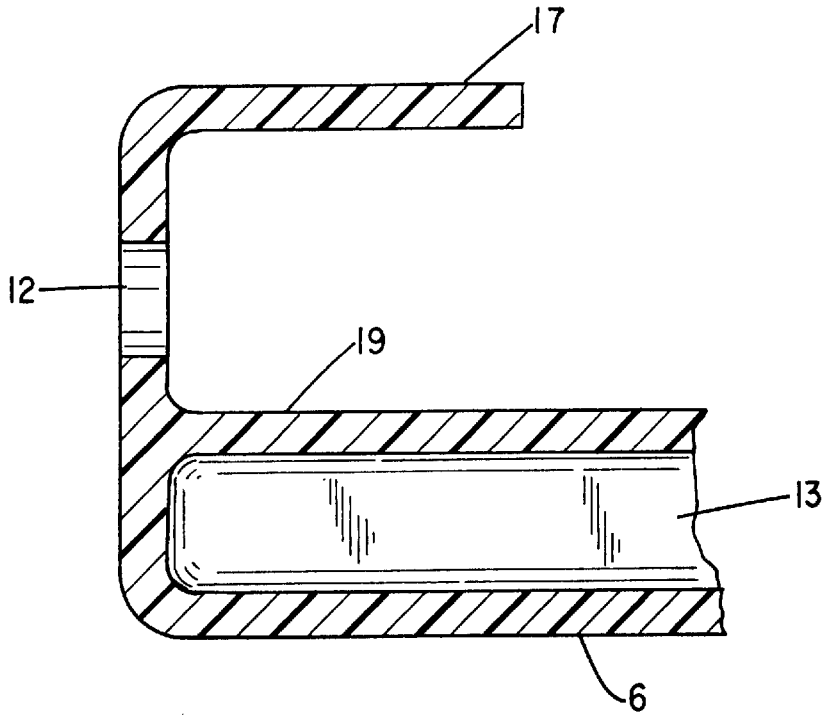
FIG. 3 is a partial section view taken along section lines 3—3 through a flanged edge of the hollow base panel of the barricade.

Braces or struts 14 are secured at hinge pins 16 to each side of the panels 4. The braces 14 mount in a number of appropriate fittings or recessed sockets 18 provided at the flanged rails or side walls 17 at the sides of the bases 6, see also FIGS. 2 and 3 Sockets 18 can also be formed into the marker panels 4. In either instance, the angle of the marker panel 4 relative to the base panel 6 can be selectively varied via the placement of the braces 14.

The elevation of the top edge of each marker panel 4, when erected, is dependant upon the socket 18 that is selected. Nominally, the panels 14 are elevated 3½ to 4 feet above the road surface. When collapsed, the panel 4 folds into the cavity 19, such that each barricade 2 exhibits a thickness in the range of 3 to 6 inches.

Appropriate amounts of ballast 20, such as sand bags, loose sand or other relatively dense materials, can be supported in the recessed cavity 19 between the rails 17 at the base panel 6 to stabilize each barricade 2 during normal use. One or more fill ports 21 and drain ports 23 might also be included in the walls of the base panel 6, if water is added to the hollow core as a ballast material. The ports 21 and/or 23, otherwise, can be used to drain and evacuate any rain or other moisture that might collect in the recess 19.

Figure 4:
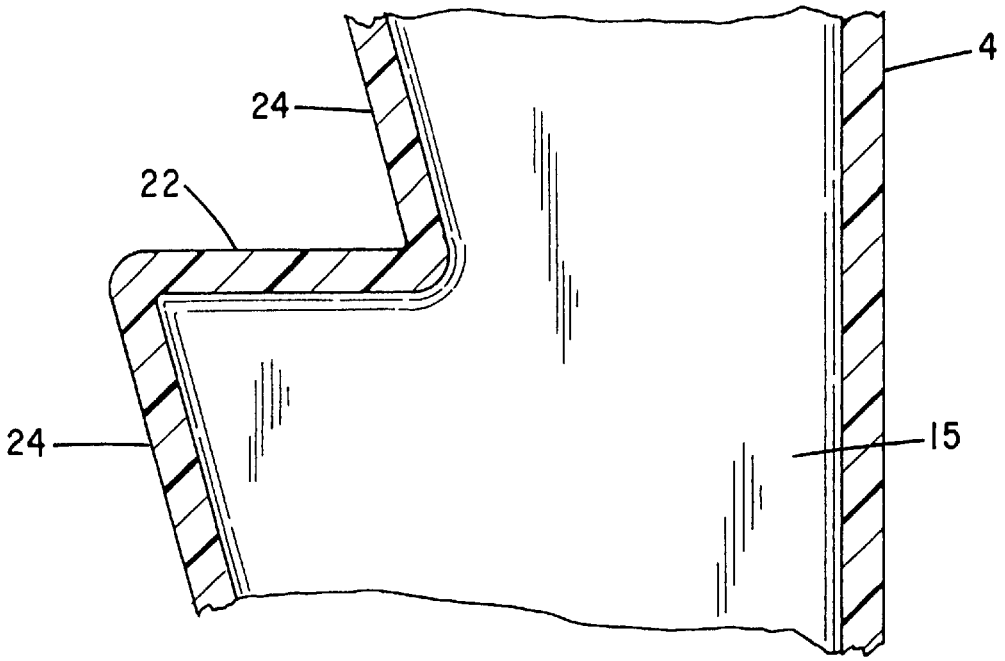
FIG. 4 is a partial section view taken along section lines 4—4 through the hollow upright panel of the barricade.

The front surface of the marker panel 4 is constructed with a series of recessed or stepped flange surfaces 22 that extend inward to an inclined louvered surface 24, see also FIG. 4. The surfaces 22 and 24 add strength to the marker panel 4 and reduce the volume of plastic required to mold each panel 4. The louvered surfaces 24 also enhance the visibility of the panels 4. Visibility is further enhanced by molding the marker panel 4 from a colored plastic or by affixing high visibility reflective or fluorescent indicia 26 and 28 to the front of the panel 4. The indicia 26 and 28 can either be painted or laminated to the marker panel 4 using a variety of commercially available paints and tapes. Predetermined areas of the panel 4 can also be molded with roughened and/or embossed regions 27 or recessed regions 29 can be provided at the exposed surface to better accept and support any indicia 26 or 28.

Selected regions of the marker panels 4 can also be fitted with appropriate lights 30 or light strips 32 that emit a constant illumination or that flash. The lights 30 and 32 can be controlled to turn on and off with changing ambient light conditions. The arrangement of any lights 30 and 32 and the color of the lighting (e.g. red, green and amber) can be adjusted as desired.

Appropriate apertures 34 or slots 36 can also be provided at the panels 4 to allow air to pass through the panels 4. The air passages 34 and 36 are particularly desired where the barricades 2 are exposed to wind, which can collapse a barricade 2. The passages 34 and 36 reduce the surface loading and stress that is countered by the braces 14 and ballast 20.

Grooves 38 are formed into the backs of the marker panel 4 to contain the braces 14, reference FIG. 2. When collapsed, the braces 14 pivot into the grooves 38 and permit the rear surface of the panel 4 to lie against the inside of the cavity 19. It is to be appreciated the braces 14 could detach from the panel 4 and that additional bracing might be provided as necessary to accommodate typical ambient wind load conditions. The braces 14 are presently made from high density plastic, although could be made from a variety of other materials.

Figure 5:
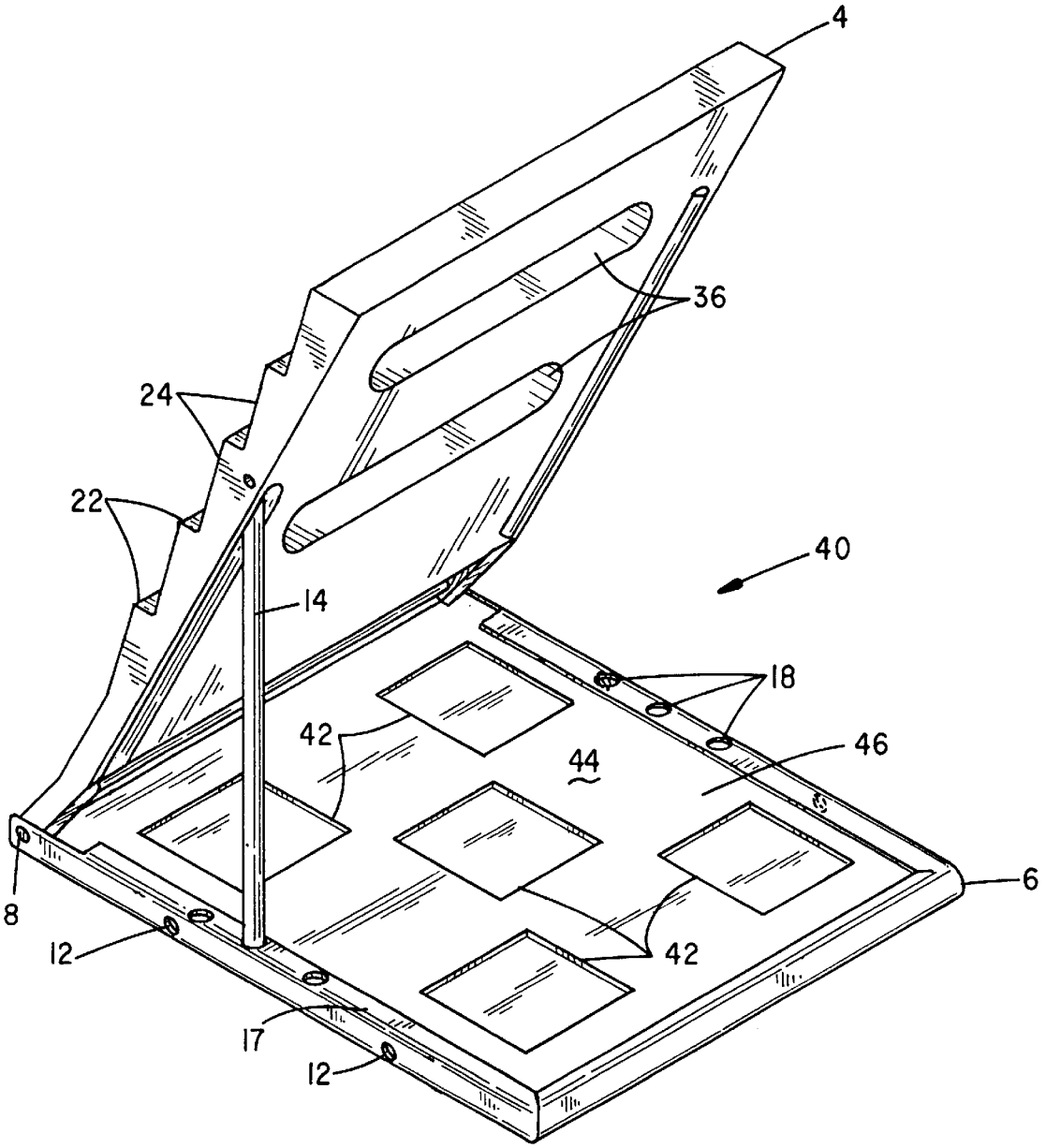
FIG. 5 is a perspective drawing showing a rear view of an assembled barricade having a ventilated upright panel and ported base panel.

Turning attention to FIG. 5, a perspective drawing is shown to a barricade 40 that provides a vented, hollow core marker panel 4 and a compressed core base panel 6. The marker panel 4 includes horizontal air passages 36 that relieve wind stress. The top and bottom walls of the base panel 6 lie essentially against each other. A number of substantial size apertures 42 reduce the weight of the base 6, yet still provide a bottom surface 44 that will support ballast 20 mounted in the recessed space 46. Although the base 6 is preferably molded from plastic, it can also be constructed as a grid or framework of members, such as steel or plastic rods or channels etc. A welded steel framework, although providing a heavy stable base is more costly to construct.

While the invention has been described with respect to a preferred construction and considered improvements or alternatives thereto, still other constructions may be suggested to those skilled in the art. The disclosed features of the invention might also be combined in different arrangements and with still other features in other barricades. The description should not be literally construed in limitation of the invention. The foregoing description should instead be construed to include all those embodiments within the spirit and scope of the following claims.

What is claimed is:

1. A molded plastic barricade, comprising:

a) a rectangular base panel having a bottom wall and a plurality of side walls that project from said bottom wall to define a cavity space, wherein said bottom and side walls include seamless, hollow cavities and wherein said side walls include a plurality of recesses; and b) a rectangular marker panel having a seamless, hollow core coupled at hinge means to said base panel to pivot between a storage condition wherein said marker panel folds into said cavity space and an upright condition wherein said marker panel spans a substantial width of a traffic lane on a roadway, wherein said marker panel includes front and rear walls, wherein said front wall is defined by a plurality of ledges that project transverse to said rear wall and a plurality of tapered surfaces that extend between a forward most edge of one of said ledges to an innermost edge of an adjoining ledge to present a louvered appearance, wherein said front wall includes indicia visible to observers, and wherein a plurality of apertures extend through said marker panel at said tapered surfaces to permit air to pass through said marker panel; and c) a brace hinged to said marker panel and selectively mountable in one of said plurality of recesses at said side walls for securing the marker panel in said upright condition.

2. A barricade as set forth in claim 1 including first and second braces, wherein said marker panel includes recesses for storing said first and second braces and wherein said first and second braces are hinged at one end to one of said marker panel and an opposite end interlocks with a selected one of said plurality of recesses at said side walls.

3. A barricade as set forth in claim 2 wherein said base panel includes means for filling and draining a ballast material from said hollow core of said base panel.

4. A barricade as set forth in claim 1 wherein said marker panel includes a recess for storing said brace.

5. A barricade as set forth in claim 1 wherein said marker panel includes a light source and means for controlling the illumination of said light source.

6. A barricade as set forth in claim 1 including a plurality of elongated members, wherein said side walls include apertures for receiving said elongated members, and wherein said elongated members extend to interconnect to the side walls of a base panel of an adjacent barricade of identical construction.

7. A barricade as set forth in claim 1 wherein the bottom wall of said base includes a plurality of apertures for draining liquid collecting in said cavity space.

8. A molded plastic barricade, comprising:

a) a base panel having a bottom wall and a plurality of side walls that project from said bottom wall to define a cavity space, wherein said bottom and side walls are hollow and wherein said side walls include a plurality of recesses; and b) a marker panel having a hollow core coupled at hinge means to said base panel to pivot between a storage condition wherein said marker panel folds into said cavity space and an upright condition wherein said marker panel spans a substantial width of a traffic lane on a roadway, wherein said marker panel includes front and rear walls, wherein said front wall is defined by a plurality of ledges that project transverse to said rear wall and a plurality of tapered surfaces that extend between a forward most edge of one of said ledges to an innermost edge of an adjoining ledge to present a louvered appearance, and wherein said front wall includes indicia visible to observers; and c) a brace mounted to said marker panel and selectively mountable in one of said plurality of recesses at said side walls for securing the marker panel in said upright condition.

9. A barricade as set forth in claim 8 wherein said marker panel includes a light source and means for controlling the illumination of said light source.

10. A barricade as set forth in claim 8 wherein said marker panel includes recesses for storing said brace.

* * * * *